US006126046A

United States Patent [19]

Baculy

[11] Patent Number: 6,126,046

[45] Date of Patent: Oct. 3, 2000

[54] SPIGOT ADAPTOR

[76] Inventor: Eric J. Baculy, 7292-15 Mile Rd., Cedar Springs, Mich. 49319

[21] Appl. No.: 09/127,407

[22] Filed: Jul. 31, 1998

[51] Int. Cl.[7] ..... B67D 3/00

[52] U.S. Cl. ..... 222/505; 222/518; 251/238; 251/251

[58] Field of Search ..... 222/400.7, 400.8, 222/402.15, 518, 505, 567, 509, 105; 239/600; 251/238, 237, 251

[56] References Cited

U.S. PATENT DOCUMENTS

| | | | |
|---|---|---|---|
| 2,370,115 | 2/1945 | Rice | 251/238 |
| 2,770,402 | 11/1956 | Quam | 222/400.7 |
| 3,807,689 | 4/1974 | Booth | 251/238 |
| 4,051,870 | 10/1977 | Nordentoft | 251/251 |
| 4,905,875 | 3/1990 | Straiton | 222/505 |
| 5,402,919 | 4/1995 | Atkinson | 222/505 |
| 5,542,584 | 8/1996 | Konar | 222/505 |
| 5,607,084 | 3/1997 | George | 222/508 X |

FOREIGN PATENT DOCUMENTS

| | | | |
|---|---|---|---|
| 266282 | 10/1913 | Germany | 222/400.7 |
| 423352 | 12/1925 | Germany | 222/402.15 |

*Primary Examiner*—Kevin Shaver
*Assistant Examiner*—Thach Bui
*Attorney, Agent, or Firm*—Price, Heneveld, Cooper, DeWitt & Litton

[57] ABSTRACT

A device for facilitating easier operation of a spigot having a body portion, a reciprocatable portion which is linearly movable with respect to the spigot body portion between an open position and a closed position to regulate fluid flow through the spigot, and a spring member urging the reciprocatable portion to the closed position, includes a mount member which is configured to be removably attachable to a portion of the spigot and an actuator member connected to the mount member. The actuator member is movable with respect to the mount member between a first location in which the actuator member, when attached to the spigot, urges the reciprocatable portion of the spigot to the open position to allow fluid to flow through the spigot, and a second location in which the actuator member, when attached to the spigot, allows the spring member of the spigot to urge the reciprocatable portion of the spigot to the closed position to prevent fluid from flowing through the spigot.

19 Claims, 6 Drawing Sheets

SPIGOT ADAPTOR

FIELD OF THE INVENTION

This invention relates to the field of dispensing liquids from a container, and, more particularly, to a device adapted to be connected to a spigot to facilitate easier operation of the spigot.

BACKGROUND OF THE INVENTION

Portable containers for holding liquids and dispensing the same through a spigot extending through the wall of the container are commonly employed at social gatherings, sporting events, construction sites, and on other occasions when it is desired to dispense water, cold beverages, or hot beverages, especially at locations where refrigeration and other amenities are not readily available. Such containers having a spigot extending through the wall of the container are available in a variety of sizes and are typically, but need not be, double walled, insulated containers. Such containers are also used by campers, picnickers, and the like for dispensing water for washing dishes, personal cleansing, etc. The spigots used on containers for dispensing liquids typically include a spigot body portion which is fixed in a wall of the container, a reciprocatable portion which is linearly movable with respect to the spigot body portion between an open position and a closed position to regulate the flow of fluid through the spigot, and a spring member urging the reciprocatable portion to the closed position. The spigots on these containers are designed to be operated with one hand. Typically, the spigot body portion includes a lip or circumferential flange which extends laterally outwardly at the free end of the spigot and the reciprocatable portion includes a blunt end which is used as a push-type button which is depressed to actuate the spigot and allow liquid to flow from the container through the spigot. The spigot can be operated by placing the index and middle fingers behind the lip or flange and depressing the blunt, push-button-like end of the reciprocatable portion. In one variation, the lip or flanges extend laterally from the end of the reciprocatable portion and a flat surface for placement of the thumb is provided at the free end of a portion of the spigot which is fixed to the container. One-handed operation of the spigot can be achieved by placing the index and center fingers behind the lips or flanges which extend laterally from the reciprocatable portion, placing the thumb on the flat end of the portion of the spigot fixed to the container, and pulling the reciprocatable portion forward. In still another variation, the spigot body portion fixed to the container includes a forwardly projecting lip at one end and a reciprocatable portion which is linearly movable in an upwardly and downwardly direction through the spigot body portion. This type of spigot can be operated by placing the index finger under the forwardly extending lip portion of the spigot body and depressing a blunt, push-type-button at the top of the reciprocatable portion.

A problem with the spigots typically used for dispensing liquids from portable containers is that many people find it difficult to operate the spigot. For example, children and the elderly often do not have sufficient strength to overcome the resistance of the spring member without difficulty. Also because of the relatively small size of the surfaces of the spigot which must be depressed in order to operate the spigot, people with long fingernails can also have difficulty operating the spigot.

Another problem with the spigots commonly employed on portable containers for holding a liquid is that the spigot must be held in the open position to allow liquid to flow from the container through the spigot. Thus, hands free operation of the spigot is not possible. As a consequence, it is relatively awkward and difficult to dispense water from the container through the spigot for personal cleansing, washing dishes, or the like, without assistance from another person.

SUMMARY OF THE INVENTION

This invention provides a device for facilitating easier operation of a spigot which includes a spigot body portion, a reciprocatable portion which is linearly movable with respect to the spigot body portion between an open position and a closed position to regulate fluid flow through the spigot, and a spring member urging the reciprocatable portion to the closed position. The device allows children, the elderly, and others having less than average strength in their fingers to easily operate these spigots. The device also includes an actuator having a relatively large surface area which enables easier manipulation and operation of the spigot, such as by people having long fingernails. The device is designed to retain the reciprocatable portion of the spigot in an open position to allow continuous flow of liquid through the spigot without manually holding the spigot in the open position. The device is useful in connection with a container including a spigot extending through a wall of the container and holding a liquid at normal atmospheric pressure, in which the liquid is dispensed from the container and through the valve under the influence of gravity alone.

The advantages of easier operation of a spigot, which includes a spigot body portion, a reciprocatable portion which is linearly movable with respect to the spigot body portion between an open position and a closed position to regulate fluid flow through the spigot, and a spring member urging the reciprocatable portion to the closed position, is achieved by a device including a mount member configured to be removably and fixedly attachable to a portion of the spigot, and an actuator member connected to the mount member. The actuator member is movable with respect to the mount member between a first location in which the actuator member, when attached to the spigot, urges the reciprocatable portion of the spigot to the open position to allow fluid to flow through the spigot, and a second location in which the actuator member, when attached to the spigot, allows the spring member of the spigot to urge the reciprocatable portion of the spigot to the closed position to prevent fluid from flowing through the spigot.

DESCRIPTION OF THE PREFERRED EMBODIMENTS

Figure 2:
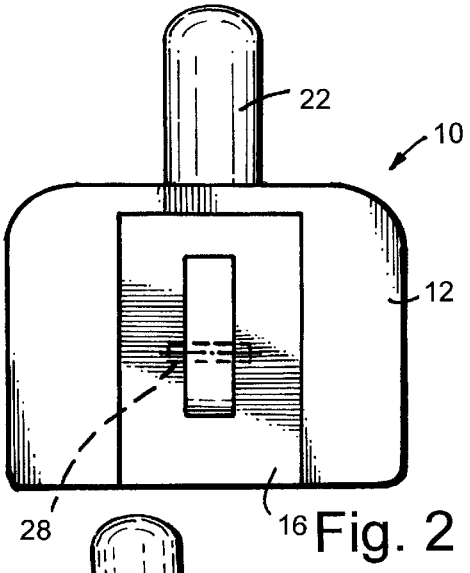
FIG. 2 is a rear elevational view of the device shown in FIG. 1.
Figure 3:
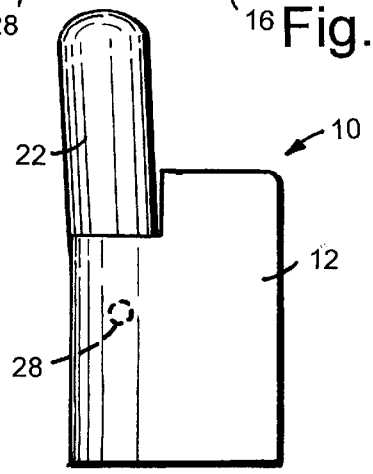
FIG. 3 is a side elevational view of the device shown in FIG. 1.
Figure 4:
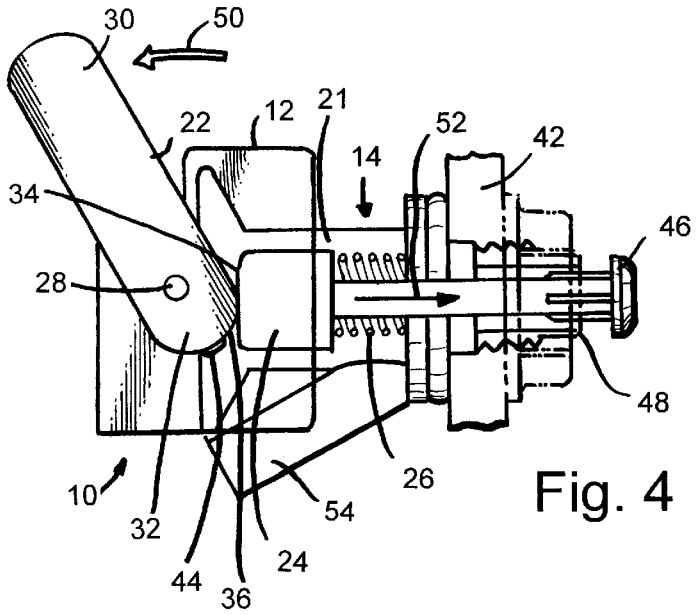
FIG. 4 is a fragmentary, side elevational, cross-sectional view of the device of FIG. 1 installed on a spigot extending through the wall of a container for holding a liquid.
Figure 5:
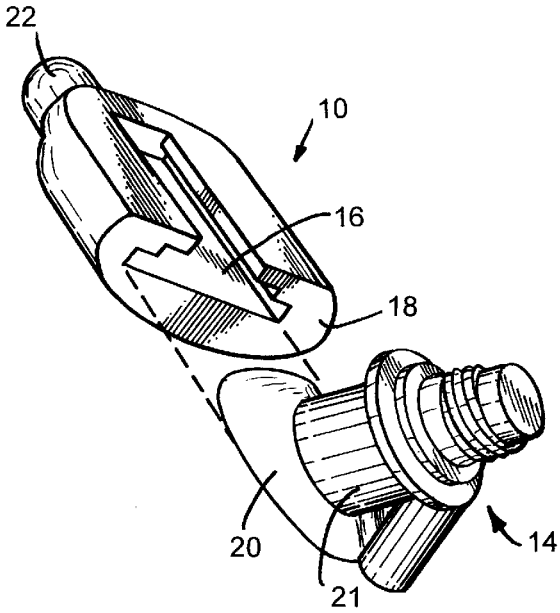
FIG. 5 is a perspective view showing how the device of FIG. 1 is installed on a spigot.
Figure 6:
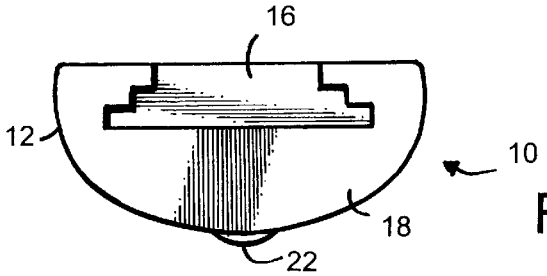
FIG. 6 is a bottom view of the device shown in FIG. 1.
Figure 10:
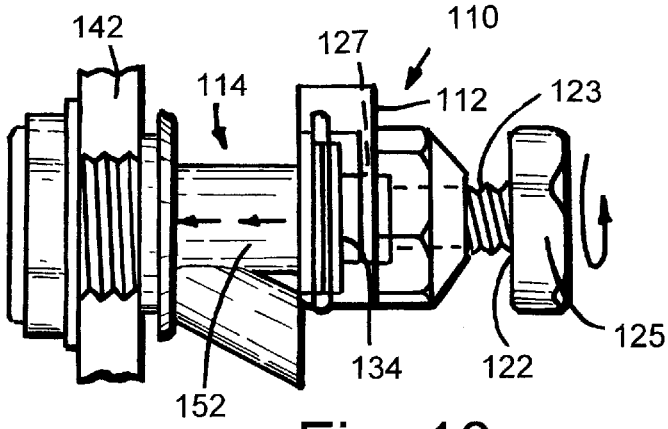
FIG. 10 is a fragmentary, side elevational, partial cross-sectional view of the device of FIG. 7 installed on a spigot extending through the wall of a container for holding a liquid.

A specific embodiment of a device for facilitating easier operation of a spigot in accordance with the invention is shown in FIGS. 1–6. The device or spigot adaptor 10 includes a mount member 12 which is configured to be removably and fixedly attachable (i.e., hold securely enough to prevent inadvertent movement of device 10 during use) to a portion of a spigot 14. Spigot 14 is used on certain beverage containers sold under the trademark Rubbermaid®. Mount member 12 is configured to define a slot 16 which is open at the bottom 18 of the mount member, and is adapted to receive a circumferential lip or flange 20 which extends laterally outwardly from a spigot body portion 21, as best illustrated in FIGS. 4 and 5. Slot 16 preferably has dimensions which allow a snug interference fit with lip or flange 20 to insure that device 10 is adequately secured to spigot 14 to prevent it from being inadvertently removed during use, yet not so snug as to make it difficult to install the device 10 on spigot 14 or to remove device 10 from spigot 14. Because spigot 14 is generally made of a deformable plastic material, a satisfactory interference fit can be achieved regardless of the materials used to make mount member 12. However, to further facilitate smooth mounting of mount member 12 on spigot 14 and dismounting of mount member 12 from spigot 14, and a snug interference fit, mount member 12 is preferably made of a relatively rigid, but slightly deformable, thermoplastic material. Examples of suitable materials include polyethylene, polypropylene, nylon, etc.

Figure 1:
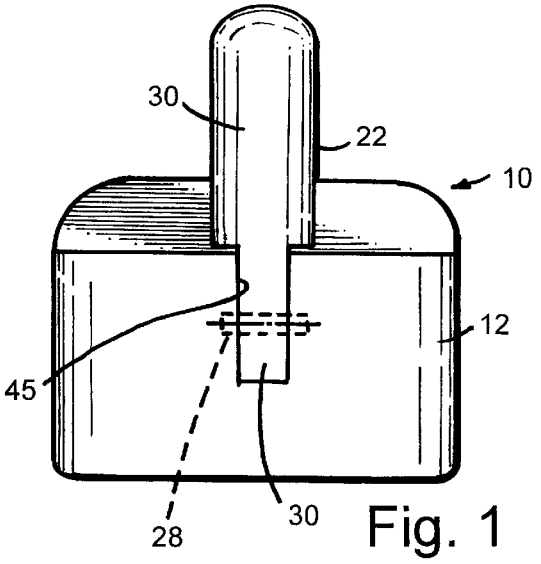
FIG. 1 is a front elevational view of a first embodiment of a device in accordance with this invention.
Figure 7:
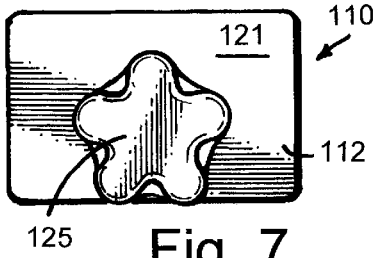
FIG. 7 is a front elevational view of a second embodiment of a device in accordance with this invention.

Connected to mount member 12 is an actuator member 22. Actuator member 22 is movable with respect to mount member 12 between a first location in which the actuator member, when attached to spigot 14, urges a reciprocatable portion 24 of the spigot to an open position to allow fluid to flow through the spigot, and a second location in which the actuator member, when attached to the spigot, allows a spring member 26 of the spigot to urge reciprocatable portion 24 of spigot 14 to a closed position to prevent fluid from flowing through spigot 14. In the illustrated embodiment of FIGS. 1–6, actuator member 22 is a lever pivotally connected to mount member 12 by a pivot pin 28. As best shown in FIGS. 1 and 4, lever 22 includes a relatively long arm portion 30 which extends upwardly away from mount member 12 to allow easy manipulation thereof, and a relatively short arm portion 32 which engages a flat push-button-type end 34 of reciprocatable portion 24 of spigot 14. Short arm portion 32 of lever 22 includes an arcuate surface 36 which engages the reciprocatable portion of spigot 14 as lever 22 is pivoted from a first location in which the reciprocatable portion 24 is at a closed position to prevent fluid from flowing through spigot 14 toward a second location wherein arcuate surface 36 bears on end 34 of reciprocatable portion 24 causing reciprocatable portion 24 to move linearly with respect to a spigot body portion 21 which is fixed relative to a container wall 42. Arcuate bearing surface 36 allows smooth operation of device 10 on spigot 14 as reciprocatable portion 24 is moved by lever 22 between open and closed positions. In the illustrated embodiment, a flat surface 44 is provided to engage the end 34 of reciprocatable portion 24 to stably retain the reciprocatable portion at an open position to allow continuous flow of fluid through spigot 14 without holding or manipulating lever 22. This feature is useful for holding the spigot in an open position to allow continuous flow of fluid such as for washing dishes or for personal cleansing, but may not always be necessary, as lever 22 will, in the illustrated embodiment, automatically stop when it comes into contact with the front groove 45 in mount member 12.

Device 10 is easily installed on spigot 14 by aligning the open end of slot 16 at bottom 18 of mount member 12 with lip or flange 20 of spigot 14 as indicated in FIG. 5, and sliding mount member 12 over lip or flange 20 as shown in FIG. 4. Device 10 is easily removed from spigot 14 by simply reversing the installation procedure, i.e., by sliding device 10 upwardly and off of lip or flange 20.

When device 10 is installed on spigot 14, long arm portion 30 of lever 22 will extend upwardly as shown in FIGS. 1–3. Spring member 26 exerts sufficient biasing force to urge reciprocatable portion 24 outwardly toward short arm portion 32 of lever 22 and to maintain lever 22 in the substantially upright vertical position shown in FIGS. 1–3, whereby a seal element 46 at the end of reciprocatable portion 24 disposed within a container at least partially defined by wall 42 is forcibly urged against a circumferential rim 48 at an end of spigot body portion 21, which is disposed at the internal side of wall 42 and which defines an opening for fluid passage through spigot 14, thus preventing the flow of fluid through spigot 14. In order to linearly move reciprocatable portion 24 inwardly to allow fluid to flow from the container through spigot 14, lever 22 is rotated downwardly and away from wall 42 in the direction indicated by arrow 50. This rotation causes short arm portion 32 of lever 22 to rotate upwardly and toward wall 42, and to engage end 34 of reciprocatable portion 24, and thus urge reciprocatable portion 24 inwardly in the direction indicated by arrow 52. This causes seal element 46 to become unseated from circumferential rim 48, and allows fluid to pass through spigot 14 and emerge from spout 54. If desired, lever 22 can be rotated downwardly and away from wall 42 until flat bearing surface 44 is engaged with the end 34 of reciprocatable portion 24, whereby reciprocatable portion 24 is stably retained in an open position without further manipulation of, and without holding, lever 22. In order to return reciprocatable portion 24 to the closed position, lever 22 is rotated upwardly toward wall 42 in a direction opposite to the direction indicated by arrow 50 until lever 22 is in an upright position as shown in FIGS. 1–3. As lever 22 is rotated upwardly, spring member 26 urges reciprocatable portion 24 outwardly away from container wall 42 in the direction opposite of that indicated by arrow 52. When lever 22 is in the full upright position as shown in FIGS. 1–3, spring member 26 is allowed to urge reciprocatable portion 24 into the fully closed position wherein seal element 46 seats against circumferential rim 48 to prevent flow of fluid through spigot 14.

Figure 8:
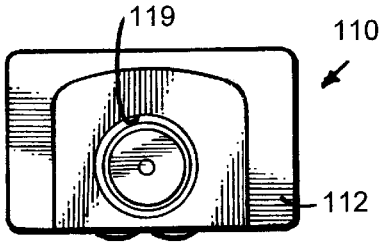
FIG. 8 is a rear elevational view of the device shown in FIG. 7.
Figure 9:
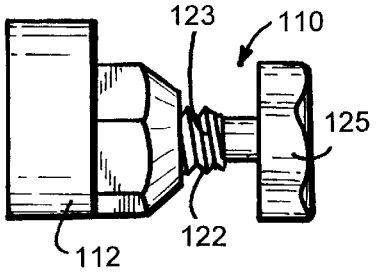
FIG. 9 is a side elevational view of the device shown in FIG. 7.
Figure 11:
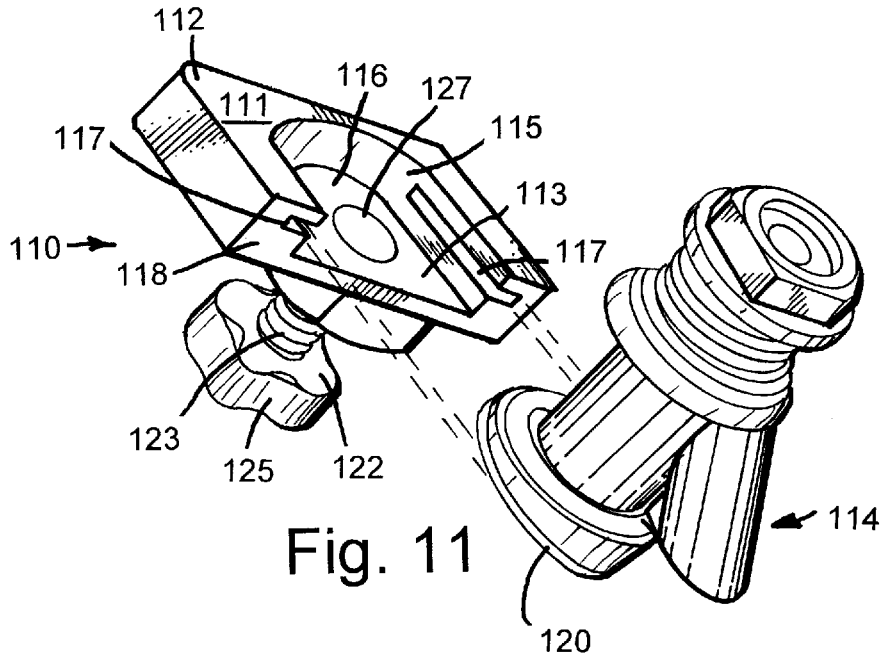
FIG. 11 is a perspective view showing how the device of FIG. 7 is installed on a spigot.
Figure 12:
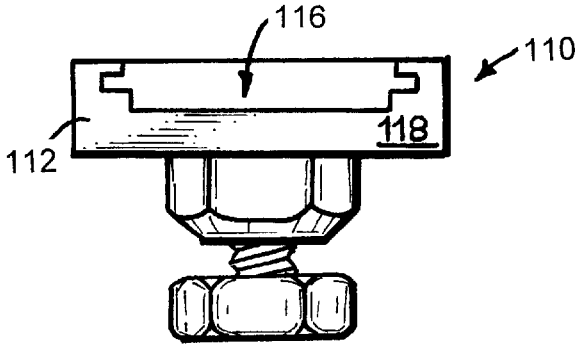
FIG. 12 is a bottom view of the device shown in FIG. 7.
Figure 13:
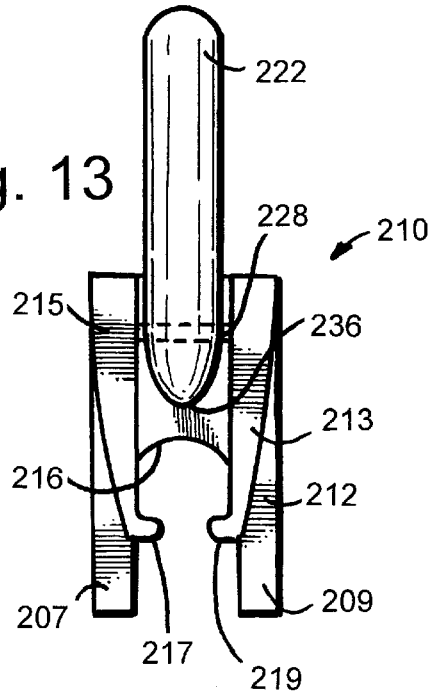
FIG. 13 is a front elevational view of a third embodiment of a device in accordance with this invention.
Figure 14:
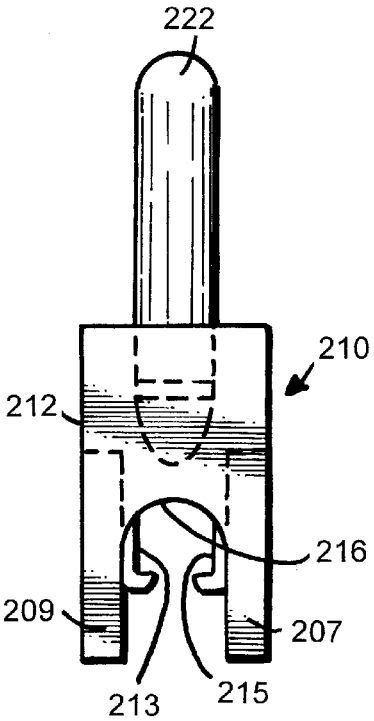
FIG. 14 is a rear elevational view of the device shown in FIG. 13.
Figure 15:
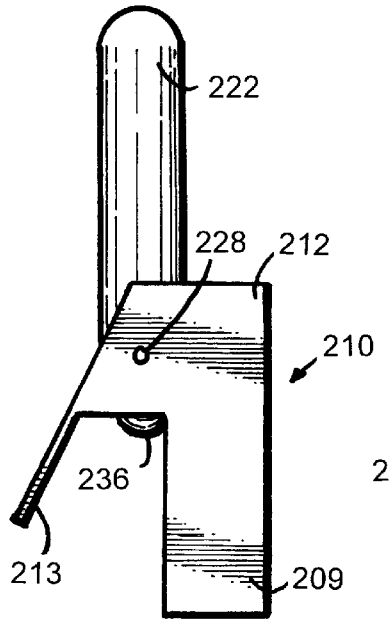
FIG. 15 is a side elevational view of the device shown in FIG. 13.
Figure 16:
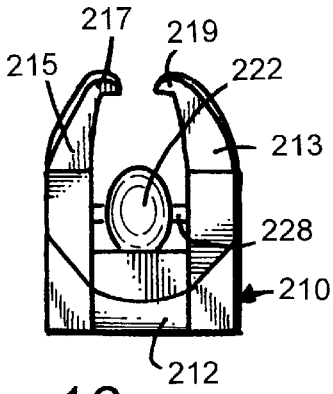
FIG. 16 is a bottom view of the device shown in FIG. 13.
Figure 17:
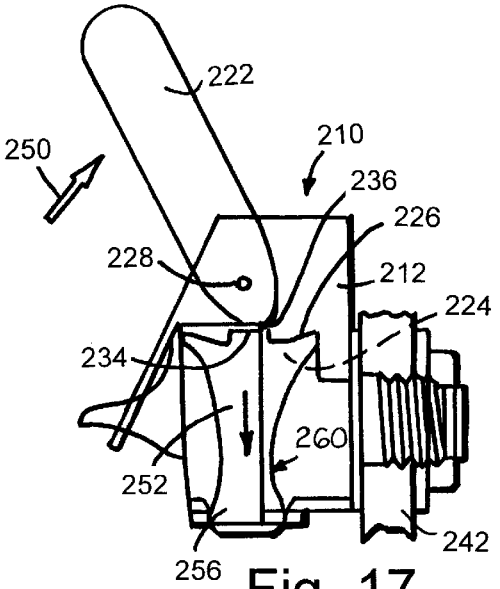
FIG. 17 is a fragmentary, side elevational, cross-sectional view of the device of FIG. 13 installed on a spigot extending through the wall of a container for holding a liquid.
Figure 19:
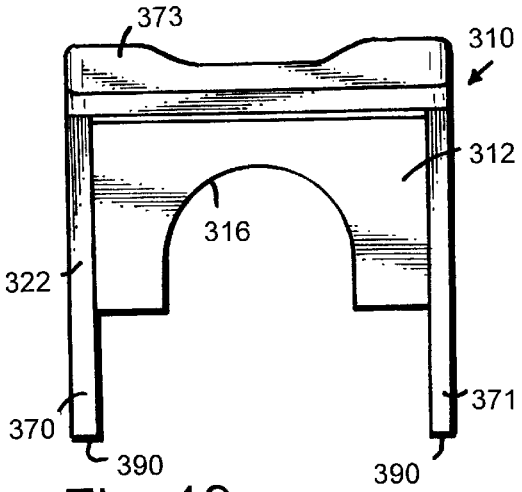
FIG. 19 is a front elevational view of a fourth embodiment of a device in accordance with this invention.

An alternative embodiment of a device in accordance with this invention is shown in FIGS. 7–12. Device 110 includes a mount member 112 which is configured to be removably and fixedly attachable (i.e., sufficiently secured to prevent inadvertent movement with respect to the spigot during use) to a portion of spigot 114. Spigot 114 is used on certain beverage containers sold by Igloo Corporation. Mount member 112 includes an inverted U-shaped recess 116 on the rearward side thereof. Recess 116 is defined by a rear wall 113 which is generally parallel with the rear wall 111 of mount member 112, and by a side wall 115 which is generally perpendicular with rear wall 113 and which has an inverted U-shaped outline as shown in FIGS. 8 and 11. The bottom 118 of mount member 112 is open to recess 116, and longitudinal grooves 117 are recessed into side wall 115 and extend along side walls 115 from bottom 118 of mount member 112 upwardly toward the top portion of U-shaped recess 116. Recess 116 and grooves 117 are configured to slide over and engage a lip or flange 120 extending laterally outwardly from the end of spigot 114 which is disposed outwardly of a container defined, at least in part, by container wall 142. The dimensions of recess 116 and grooves 117 are selected to provide a secure interference fit with lip or flange 120 such that device 110 is sufficiently secured to spigot 114 so that inadvertent removal of device 110 from spigot 114 does not occur during operation. However, the dimensions are selected so that device 110 can be easily slipped over flange 120 and removed therefrom as desired.

Mount member 112 includes a threaded bore 119 which extends through mount member 112 from the front face 121 of mount member 112 to rear wall 113 of recess 116. The embodiment of the invention illustrated in FIGS. 7–12 includes a screw type actuator member 122 including an externally threaded screw shaft 123 and a rotary knob 125 rigidly fixed to an end of shaft 123. Screw shaft 123 is disposed within threaded bore 119, with the external threads of shaft 123 engaging the internal threads of bore 119, whereby linear displacement of screw type actuator 122 along its longitudinal axis is effected by rotation of shaft 123 about its longitudinal axis, such as by rotating knob 125. A bearing element 127 is connected to shaft 123 at the end thereof opposite knob 125. In order to prevent excessive wear on a pushbutton-type surface 134 at the end of spigot 114 which is engaged by bearing element 127, bearing element 127 may be journaled to the end of shaft 123 opposite knob 125 so that shaft 123 is free to rotate independent of bearing element 127 when bearing element 127 tightly abuts surface 134 of the push-button.

Device 110 is installed on spigot 114 by aligning grooves 117 with lip or flange 120 as indicated in FIG. 11, and by sliding mount member 112 onto spigot 114 so that lip or flange 120 is received in grooves 117. Device 110 is shown in the fully installed position in FIG. 10, with shaft 123 and bearing element 127 aligned with surface 134 of the push-type-button. Removal of device 110 is achieved by sliding device 110 upwardly and off of lip or flange 120. Spigot 114 is generally similar to previously described spigot 14 and operates in a similar manner as spigot 14. The principle difference between device 110 and device 10 is that device 110 uses a screw shaft type actuator member rather than a lever type actuator member. Accordingly, operation of device 110 involves rotation of screw shaft 123 about its longitudinal axis in order to cause linear movement of bearing element 127 in the direction indicated by arrow 152, or in a direction opposite to that indicated by arrow 152. As with the previously described embodiment (device 10) screw shaft type actuator member 122 is movable with respect to the mount member between a first location in which the actuator member, when the device is attached to the spigot, urges the reciprocatable portion of the spigot to an open position to allow fluid to flow through the spigot, and a second location in which the actuator member, when the device is attached to the spigot, allows the spring member of the spigot to urge the reciprocatable portion of the spigot to the closed position to prevent fluid from flowing through the spigot. The screw type actuator member has the advantage of allowing the reciprocatable portion of the spigot to be held in any of an infinite number of positions between the open and closed positions without manually holding the spigot in the open position.

Each of the illustrated devices 10 and 110 shown in FIGS. 1–12 can be used (i.e., are interchangeable) with either of the illustrated spigots 14 and 114.

Another alternative embodiment of the device of this invention is shown in FIGS. 1318. Device 210 includes a mount member 212 which is configured to be removably and fixedly attachable to a spigot 214 (shown in FIG. 18). Spigot 214 is used on certain ice tea containers/dispensers sold at a variety of retail establishments. Mount member 212 includes a pair of spaced apart, downwardly depending legs 207, 209 and an inverted U-shaped notch generally defined by and located between legs 207, 209. Legs 207, 209 are designed to straddle opposite sides of a neck portion 211 of spigot 214, with the upper end of the inverted U-shaped notch engaging and/or bearing upon the top side of neck portion 211. Mount member 212 also includes a pair of spaced apart arms 213, 215 which extend downwardly from an upper portion of mount member 212. Arms 213, 215 include, at the free ends thereof, inwardly turned foot portions 217, 219 which engage the underside of a hook like portion 220 which projects forwardly from the outwardly facing end of spigot 214.

Spigot 214 differs from spigot 14 and 114 in that the reciprocatable portion 224 of spigot 214 moves linearly upwardly and downwardly within a barrel shaped portion 225 of a spigot body element 227 which is rigidly mounted on a container wall 242. Another significant difference is that spring member 226 is a diaphragm-like portion integrally formed as a part of reciprocatable portion 224.

A lever type actuator member 222 is pivotally connected to mount member 212 by a pivot pin 228.

Figure 18:
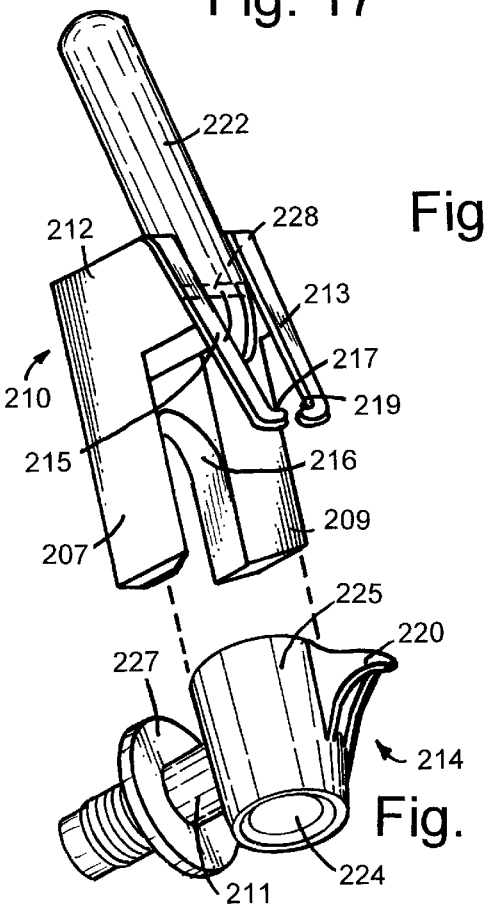
FIG. 18 is a perspective view showing how the device of FIG. 13 is installed on a spigot.
Figure 20:
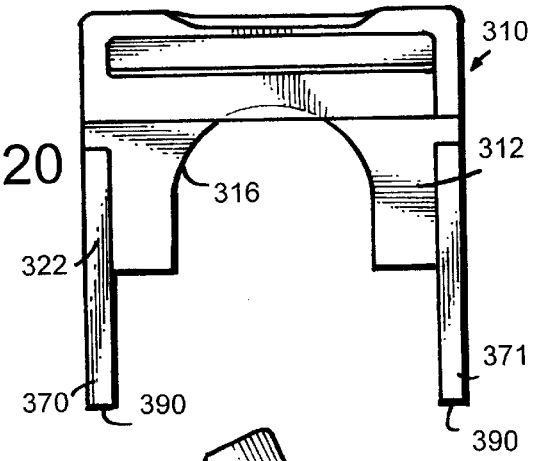
FIG. 20 is a rear elevational view of the device shown in FIG. 19.
Figure 21:
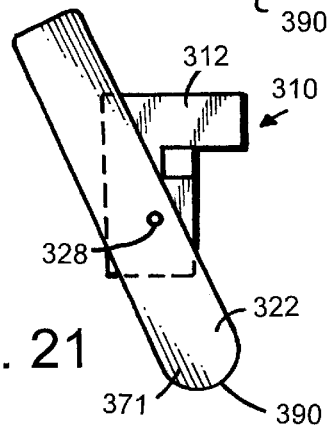
FIG. 21 is a side elevational view of the device shown in FIG. 19.

Device 210 is installed on spigot 214 by aligning legs 207, 209 on opposite sides of neck portion 211 of spigot 214 as indicated in FIG. 18, and by sliding mount member 212 downwardly onto spigot 214 so that the upper portion of U-shaped notch 216 abuts the top of neck portion 211 of spigot 214, and feet portions 217, 219 snap underneath hook-like projection 220.

Operation of the device is achieved by rotating lever 222 upwardly and toward wall 242 in the direction indicated by arrow 250. Upon rotation of lever 222 upwardly and toward wall 242, a bearing surface 236 at the end of lever 222 which is closest to pivot pin 228 bears upon a push-type button 234, causing button 234 to be depressed downwardly, whereby a lower portion 256 of reciprocatable portion 224 is moved downwardly as indicated by arrow 252. This causes a rather large diameter section of reciprocatable portion 224 to become unseated from an aperture defined at a lower portion of spigot 214 and a relatively smaller diameter section of reciprocatable portion 224 to become positioned within the aperture thereby defining an annular region between the lower portion 256 of reciprocatable portion 224 and the rim of the aperture, whereby liquid can flow through spigot 214 and out of the annular region defined between the reciprocatable portion and the rim of the aperture. When lever 222 is rotated downwardly and away from wall 242 in a direction opposite to that indicated by arrow 250, button 234 is released and spring member 226 urges reciprocatable portion 224 into a closed position wherein the lower end 256 of the reciprocatable portion 224 becomes seated against the rim of the aperture defined in the lower portion of spigot 214.

A further alternative embodiment of a device in accordance with this invention is shown in FIGS. 19–23. Device 310 includes a mount member 312 which is configured to be removably and fixedly attachable to a portion of a spigot 314 (shown in FIGS. 22 and 23). Spigot 314 is used on certain beverage containers sold by Coleman Co., Inc. An inverted U-shaped notch 316 is defined in mount member 312. Notch 316 is adapted to receive a neck portion 315 of spigot 314, to facilitate mounting of device 310 on spigot 314. Spigot 314 differs from those previously described (14, 114 and 214) in that the reciprocatable portion 324 of spigot 314 is pulled forwardly away from the wall of container 380 to open spigot 314, and spring member 326 urges reciprocatable portion 324 toward container 380 into a closed position. Accordingly, unlike the previous embodiments, device 310 is adapted to be connected to reciprocatable portion 324 of spigot 314, rather than a portion which is stationary relative to the container wall.

A bifurcated lever assembly or actuator member 322 is pivotally connected to mount member 312 for rotation about pivot pins 328. Actuator member 322 includes first and second levers 370, 371 which are rigidly connected together by a bridge 373, which can be grasped to operate spigot 314 by rotating actuator member 322 in the direction indicated by arrow 350.

Device 310 is installed onto spigot 314 by sliding the notch portion 316 of mount member 312 onto a neck portion 315 of spigot 314. Removal of device 310 is achieved by merely pulling device 310 upwardly off of spigot 314.

Figure 22:
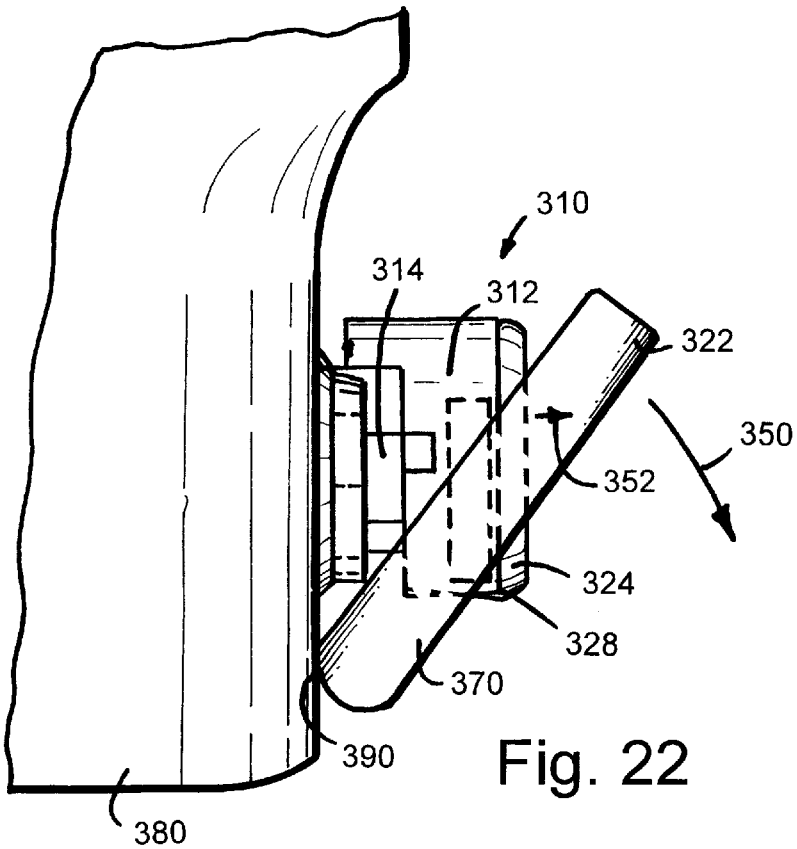
FIG. 22 is a fragmentary, side elevation view of the device of FIG. 19 installed on a spigot extending through the wall of a container for holding a liquid.
Figure 23:
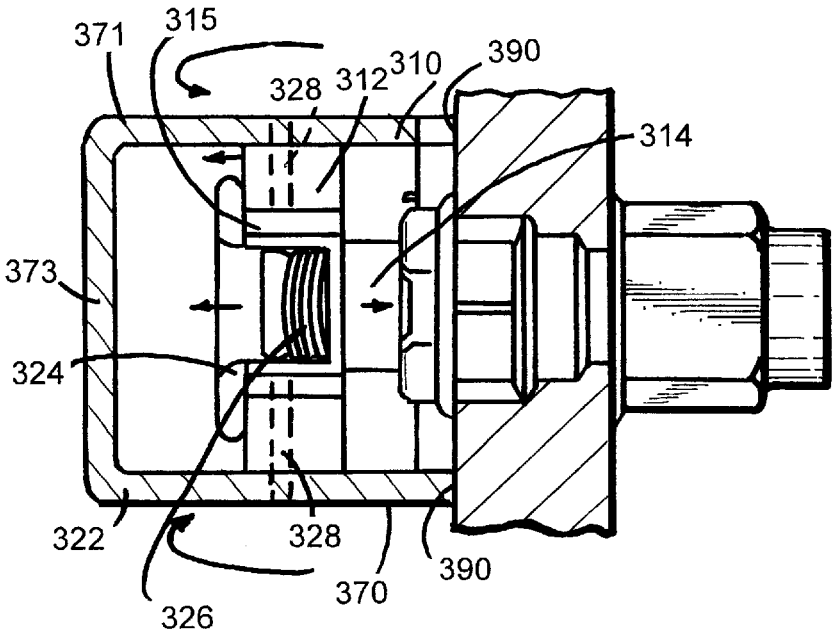
FIG. 23 is a fragmentary, bottom view of the device of FIG. 19 installed on a spigot extending through the wall of a container for holding a liquid.

Spigot 314 is shown in FIG. 22 with the reciprocatable portion 324 in the closed position, and with device 310 installed thereon. Reciprocatable portion 324 is pulled outwardly away from the wall of container 380 into the open position by rotating actuator member 322 in the direction indicated by arrow 350. This causes the free ends 390 of levers 370, 371 to slide upwardly along the exterior of the wall of container 380, thereby causing pivot pin 328 and mount member 312 to move outwardly away from the container in the direction indicated by arrow 352, which, in turn, causes reciprocatable portion 324, which is connected with mount member 312, to also move outwardly away from container 380 in the direction indicated by arrow 352, and into an open position without manually holding down actuator member 322 (as shown in FIG. 23) whereby liquid can flow from container 380 through spigot 314 without manually holding down actuator member 322. Upon applying upward pressure and subsequent release of lever 322, spring member 326 returns reciprocatable portion 324 and actuator member 322 into the closed position.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

What is claimed is:

1. A combination for dispensing a liquid, comprising:

a spigot which includes a spigot body portion, a reciprocatable portion which is linearly movable with respect to the spigot body portion between an open position and a closed position to regulate fluid flow through the spigot, and a spring member urging the reciprocatable portion to the closed position; and a device removably mounted on the spigot to facilitate easier operation of the spigot, the device including a mount member removably attached to a portion of the spigot, and an actuator member connected directly to the mount member, the actuator member being movable with respect to the mount member between a first location in which the actuator member urges the reciprocatable portion of the spigot to the open position to allow fluid to flow through the spigot, and a second location in which the actuator member allows the spring member to urge the reciprocatable portion of the spigot to the closed position to prevent fluid from flowing through the spigot.

2. The device of claim 1, wherein the actuator member is a lever pivotally connected to the mount member, the actuator lever including a first free end for manipulation thereof and a second opposite free end for engaging the reciprocatable portion of the spigot.

3. The device of claim 1, wherein the actuator member is a lever pivotally connected to the mount member, the actuator lever including a first end for manipulation thereof and a second opposite end for engaging a wall of a container through which the spigot extends.

4. The device of claim 1, wherein the mount member includes an internally threaded bore and the actuator member includes an externally threaded shaft, the threads of the shaft being engaged with the threads of the bore, whereby the shaft is linearly displaceable with respect to the mount member upon rotation of the shaft with respect to the mount member.

5. The device of claim 2, wherein the second free end of the lever includes an arcuate surface which engages the reciprocatable portion of the spigot as the lever is pivoted from the first location toward the second location.

6. The device of claim 2, wherein the second free end of the lever includes a surface which engages the reciprocatable portion of the spigot when the lever is in the second position, the surface of the second free end of the lever being engagable with a surface of the reciprocatable portion of the spigot to stably retain the reciprocatable portion at the open position to allow continuous flow of fluids through the spigot without holding or manipulating the lever.

7. A combination for holding and dispensing a liquid comprising:

a container;

a spigot installed in an opening defined through a wall of the container for dispensing a liquid from the container, the spigot including a spigot body, a reciprocatable portion which is linearly movable with respect to the spigot body portion between an open position and a closed position to regulate fluid flow through the spigot, and a spring member urging the reciprocatable portion to the closed position; and a device for facilitating easier operation of the spigot, the device including a mount member removably attached to a portion of the spigot, and an actuator member connected directly to the mount member, the actuator member being movable with respect to the mount member between a first location in which the actuator member urges the reciprocatable portion of the spigot to the open position to allow a liquid to flow through the spigot, and a second location in which the actuator member allows the spring member of the spigot to urge the reciprocatable portion of the spigot to the closed position to prevent the liquid from flowing through the spigot.

8. The combination of claim 7, wherein the actuator member is a lever pivotally connected to the mount member, the actuator lever including a first free end for manipulation thereof and a second opposite free end for engaging the reciprocatable portion of the spigot.

9. The combination of claim 7, wherein the actuator member is a lever pivotally connected to the mount member, the actuator lever including a first end for manipulation thereof and a second opposite end for engaging a wall of a container through which the spigot extends.

10. The combination of claim 7, wherein the mount member includes an internally threaded bore and the actuator member includes an externally threaded shaft, the threads of the shaft being engaged with the threads of the bore, whereby the shaft is linearly displaceable with respect to the mount member upon rotation of the shaft with respect to the mount member.

11. The combination of claim 8, wherein the second free end of the lever includes an arcuate surface which engages the reciprocatable portion of the spigot as the lever is pivoted from the first location toward the second location.

12. The combination of claim 8, wherein the second free end of the lever includes a surface which engages the reciprocatable portion of the spigot when the lever is in the second position, the surface of the second free end of the lever being engagable with a surface of the reciprocatable portion of the spigot to stably retain the reciprocatable portion at the open position to allow continuous flow of fluids through the spigot without holding or manipulating the lever.

13. A combination for holding and dispensing a liquid at atmospheric pressure, comprising:

a container;

a spigot installed in an opening defined through a wall of the container for dispensing a liquid from the container, gravity being the driving force for dispensing the liquid from the container through the spigot, the spigot including a spigot body portion, a reciprocatable portion which is linearly movable with respect to the spigot body portion between an open position and a closed position to regulate fluid flow through the spigot, and a spring member urging the reciprocatable portion to the closed position; and a device for facilitating easier operation of the spigot, the device including a mount member removably attached to a portion of the spigot, and an actuator member connected directly to the mount member, the actuator member being movable with respect to the mount member between a first location in which the actuator member urges the reciprocatable portion of the spigot to the open position to allow the liquid to flow through the spigot, and a second location in which the actuator member allows the spring member of the spigot to urge the reciprocatable portion of the spigot to the closed position to prevent the liquid from flowing through the spigot.

14. The combination of claim 13, wherein the actuator member is a lever pivotally connected to the mount member, the actuator lever including a first free end for manipulation thereof and a second opposite free end for engaging the reciprocatable portion of the spigot.

15. The combination of claim 13, wherein the actuator member is a lever pivotally connected to the mount member, the actuator lever including a first end for manipulation thereof and a second opposite end for engaging a wall of a container through which the spigot extends.

16. The combination of claim 13, wherein the mount member includes an internally threaded bore and the actuator member includes an externally threaded shaft, the threads of the shaft being engaged with the threads of the bore, whereby the shaft is linearly displaceable with respect to the mount member upon rotation of the shaft with respect to the mount member.

17. The combination of claim 14, wherein the second free end of the lever includes an arcuate surface which engages the reciprocatable portion of the spigot as the lever is pivoted from the first location toward the second location.

18. The combination of claim 14, wherein the second free end of the lever includes a surface which engages the reciprocatable portion of the spigot when the lever is in the second position, the surface of the second free end of the lever being engagable with a surface of the reciprocatable portion of the spigot to stably retain the reciprocatable portion at the open position to allow continuous flow of fluids through the spigot without holding or manipulating the lever.

19. A device for facilitating easier operation of a spigot, wherein the spigot includes a spigot body portion, a reciprocatable portion which is linearly removable with respect to the spigot body portion between an open position and a closed position to regulate fluid flow through the spigot, and a spring member urging the reciprocatable portion to the closed position, the device comprising:

a mount member configured to be removably attachable to a portion of a spigot; and a lever pivotally connected directly to the mount member, the lever being movable with respect to the mount member between a first location in which the lever urges the reciprocatable portion of the spigot to the open position to allow a liquid to flow through the spigot when the device is attached to the spigot, and a second location in which the lever allows the spring member to urge the reciprocatable portion of the spigot to the closed position to prevent the liquid from flowing through the spigot when the device is attached to the spigot, the lever including a first end for manipulation thereof and a second opposite end for engaging the reciprocatable portion of the spigot, the second free end of the lever including a surface which engages the recirprocatable portion of the spigot when the lever is in the second position, the surface of the second free end of the lever being engagable with a surface of the reciprocatable portion of the spigot to stably retain the reciprocatable portion at the open position to allow continuous flow of the liquid through the spigot without holding or manipulating the lever.

* * * * *